US006929321B1

(12) United States Patent
Shrock

(10) Patent No.: US 6,929,321 B1
(45) Date of Patent: Aug. 16, 2005

(54) FOLD-UP SEAT

(76) Inventor: Scott J. Shrock, 28531 Jami St., Elkhart, IN (US) 46514

( * ) Notice: Subject to any disclaimer, the term of this patent is extended or adjusted under 35 U.S.C. 154(b) by 0 days.

(21) Appl. No.: 10/819,725

(22) Filed: Apr. 7, 2004

Related U.S. Application Data

(60) Provisional application No. 60/462,067, filed on Apr. 11, 2003.

(51) Int. Cl.[7] ..... A47C 13/00; A47C 17/14; A47C 17/18; A47C 17/213; A47C 17/34

(52) U.S. Cl. ..... 297/118; 297/1; 297/105; 297/158.1; 297/188.08; 297/188.09; 297/188.1; 297/245

(58) Field of Search ..... 297/118, 1, 105, 297/245, 158.1, 188.08, 188.09, 188.1

(56) References Cited

U.S. PATENT DOCUMENTS

| | | | | | |
|---|---|---|---|---|---|
| 120,270 | A | * | 10/1871 | Hall | 297/118 X |
| 380,170 | A | * | 3/1888 | Blyndeburgh | 297/105 |
| 583,179 | A | * | 5/1897 | Holman | 297/118 X |
| 907,311 | A | * | 12/1908 | Bowdon | 297/118 X |
| 924,148 | A | * | 6/1909 | De Vore | 297/188.1 |
| 1,599,588 | A | * | 9/1926 | Putnam | 297/118 |
| 2,613,369 | A | * | 10/1952 | Lorenz et al. | 297/188.09 X |
| 2,720,659 | A | * | 10/1955 | Brown | 297/118 X |
| 2,804,122 | A | * | 8/1957 | Baum | 297/118.1 X |
| 3,386,110 | A | * | 6/1968 | Vanhentenrijk et al. | 297/118 X |
| 3,432,203 | A | * | 3/1969 | Cavalli | 297/118 X |
| 3,504,940 | A | * | 4/1970 | Friese | 297/105 |
| 3,672,719 | A | * | 6/1972 | Haukedahl | 297/118 |
| 3,722,011 | A | * | 3/1973 | Miller | 297/118.09 |
| 3,738,699 | A | * | 6/1973 | Fain | 297/158.1 X |
| 3,867,730 | A | * | 2/1975 | Wright | 297/118 X |
| 3,906,558 | A | * | 9/1975 | Alembik | 297/118 |
| 4,200,329 | A | * | 4/1980 | Inami et al. | 297/118 X |
| 4,248,476 | A | * | 2/1981 | Phelps | 297/118 |
| 4,282,613 | A | * | 8/1981 | Violante | 297/118 X |
| 4,506,927 | A | * | 3/1985 | Lombardo | 297/118 |
| 5,466,041 | A | * | 11/1995 | Hoffman et al. | 297/188.1 |
| 5,538,320 | A | * | 7/1996 | Hoffman et al. | 297/188.1 |
| 5,584,530 | A | * | 12/1996 | Rogers et al. | 297/188.1 |
| 5,597,199 | A | * | 1/1997 | Hoffman et al. | 297/118 X |
| 5,622,404 | A | * | 4/1997 | Menne | 297/188.1 |
| 5,902,009 | A | * | 5/1999 | Singh et al. | 297/188.1 |
| 6,367,873 | B1 | * | 4/2002 | Dorner et al. | 297/118 X |
| 2002/0005649 | A1 | * | 1/2002 | Hofmann et al. | 297/188.1 X |

FOREIGN PATENT DOCUMENTS

| | | | | | |
|---|---|---|---|---|---|
| DE | 3213442 | A1 | * | 10/1983 | 297/118 |
| DE | 3512581 | A1 | * | 10/1986 | 297/188.08 |
| EP | 291894 | A2 | * | 11/1988 | 297/245 |
| FR | 2644048 | A1 | * | 9/1990 | 297/1 |
| GB | 2082903 | | * | 9/1982 | 297/118 |
| GB | 2267216 | A | * | 12/1993 | 297/118 |
| JP | 55102733 | A | * | 8/1980 | 297/118 |

* cited by examiner

*Primary Examiner*—Rodney B. White

(57) ABSTRACT

A fold-up seat mountable in mobile living quarters has a sidewall defining a storage space covered by a seat platform. The seat platform can be opened and closed about a hinge apparatus to provide access to the storage area when the seat platform is open and provides a place for sitting when the seat platform is closed.

3 Claims, 6 Drawing Sheets

FOLD-UP SEAT

CROSS REFERENCE TO RELATED APPLICATIONS

This Application claims the benefit of Provisional U.S. Patent Application No. 60/462,067 filed 11 Apr. 2003 by Scott J. Shrock.

FIELD OF THE INVENTION

This invention relates to a fold-up seat useable in mobile living quarters.

BACKGROUND OF THE INVENTION

In mobile living quarters such as recreational vehicles, space is always at a premium. Therefore it is often desirable for the various pieces of furniture within the mobile living quarters to have multiple uses. One such piece of multi-use furniture is a bench or seat that can also be used as a storage space, or storage seat. In this item the seat will usually have a storage space defined by four walls carried by the floor of the living quarters and a removable cover on top of the four walls on which a person may sit.

Up till now such a storage seat was generally accessible only by having a seat cover which was completely removable from the four support walls. This was usually accomplished by simply having a platform such as a piece of plywood with a seat cushion attached thereon placed loosely on top of the four walls. When it was desired to access the storage space beneath the cover, it was necessary to lift the cover off of the walls and usually place it someplace else while accessing the storage space. Although economical, this arrangement could also prove to be inconvenient because it required the user to find a place to put the cover while accessing the storage place beneath. Therefore it would be desirable to have a seat with a storage compartment underneath where the storage compartment may be readily accessed without having to completely remove the seat platform.

SUMMARY OF THE INVENTION

A fold-up seat is presented which is useable in mobile living quarters. The cover and walls of the seat define a storage area that can be accessed by folding the cover up to an open position. When the cover is folded down in its closed position it may be used for sitting upon.

One object of the invention described herein is to provide a storage seat that allows simplified access from above to the storage area below the seating platform.

BRIEF DESCRIPTION OF THE DRAWINGS

These and other aspects and objects of the invention will be apparent from the following description, with reference to the accompanying drawings, in which.

DETAILED DESCRIPTION

Figure 1:
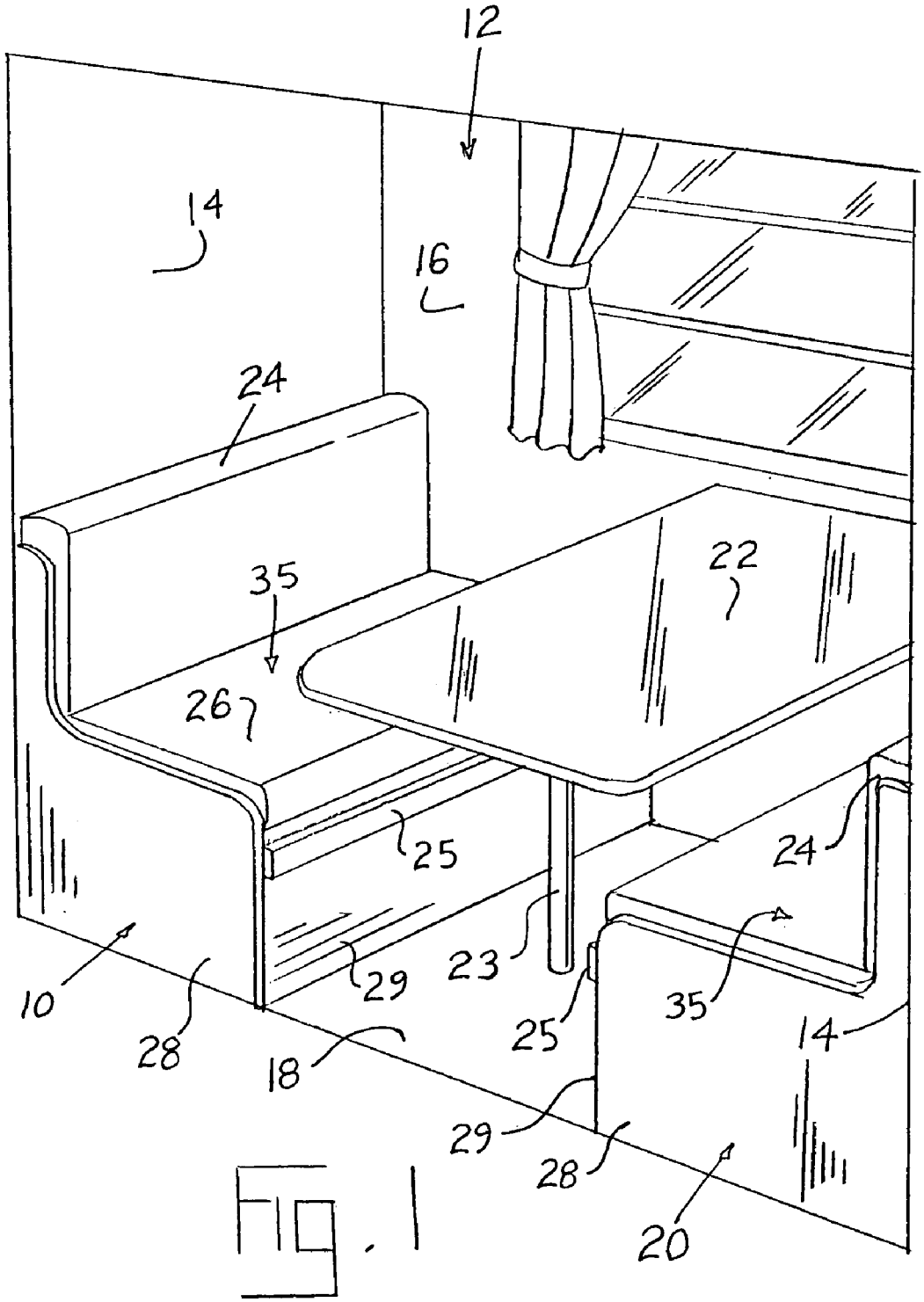
FIG. 1 shows a pair of fold-up seats installed in mobile living quarters.
Figure 2:
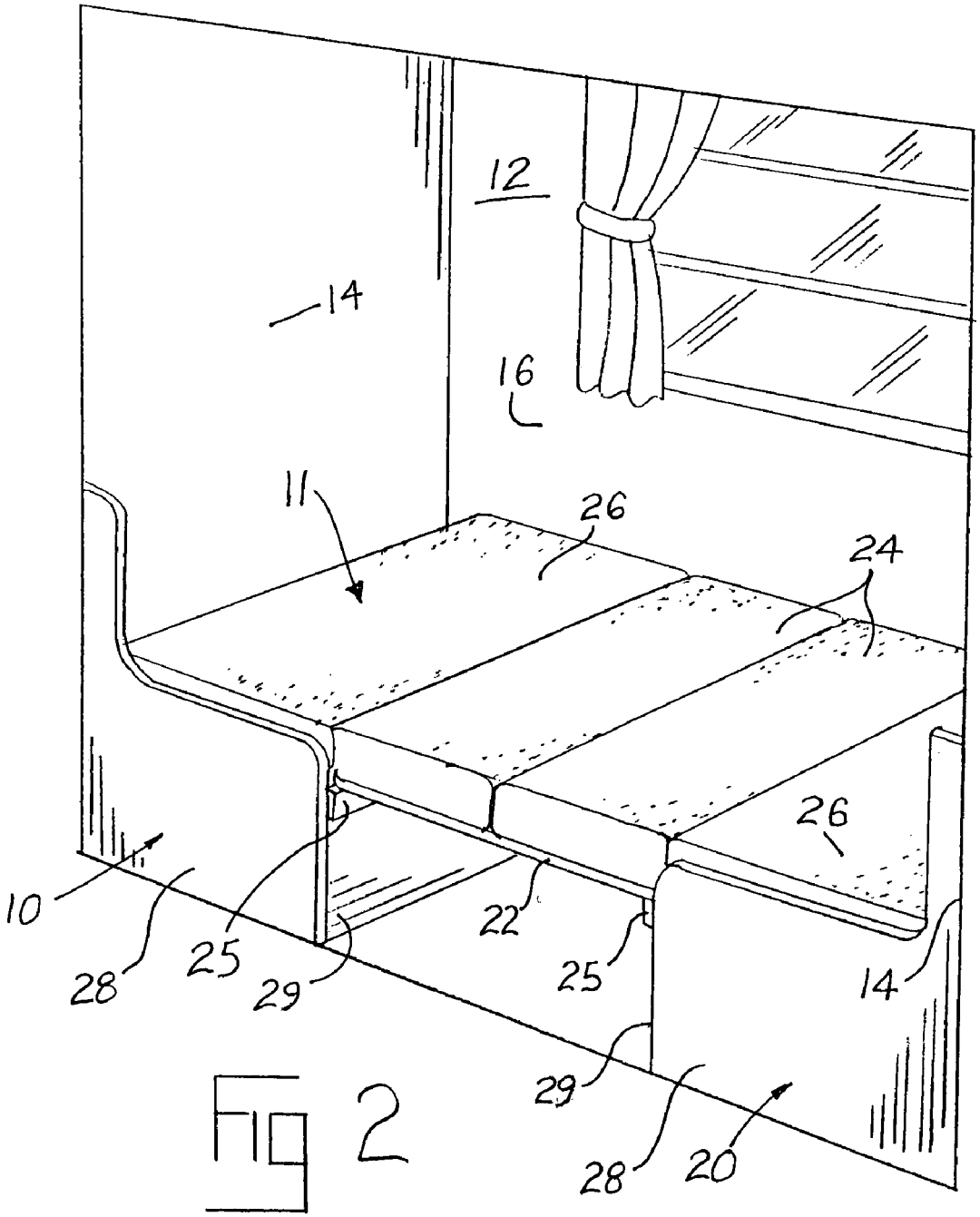
FIG. 2 shows a pair of fold-up seats in a mobile living quarters as used as part of a bed.

Referring now to the drawings, FIGS. 1 and 2 depict a fold-up seat 10 installed in a mobile living quarters 12. Seat 10 is positioned adjacent a wall 14 and side wall 16 of the mobile living quarters and rests upon floor 18 such that wall 14 may also act as a backrest. In the preferred embodiment a pair of fold-up seats 10 and 20 are located opposite each other and set against opposite walls 14. A table top 22 detachably supported by side wall 16 and removable support leg 23 is positioned between fold-up seats 10, 20 thereby defining a comfortable booth-like seating arrangement. Back cushion 24 is removably attached to rear wall 14 and seat cushion 26 is attached to cushion frame 36 to form the cover 35.

As depicted in FIG. 2, fold-up seats 10, 20 and tabletop 22 may be arranged to create a bed or sofa 11. To do this, table top 22 is detached from side wall 16 and removable leg 23 is removed from underneath the table top. Table top 22 is then placed between fold-up seats 10, 20 with its opposite edges resting on opposing ledges 25, which are carried by opposing sidewalls 29 of the opposing fold-up seats 10, 20. Back cushions 24 are then removed from rear walls 14 and placed on top of table top 22 adjacent each other and with seat cushions 26 on either side, thereby forming a generally continuous sleeping surface. When it is desired to again use the space as a booth, back cushions 24 are reattached to rear walls 14, table top 22 is reattached to side wall 16, and leg 23 is repositioned under the table top for support thereof.

Figure 3:
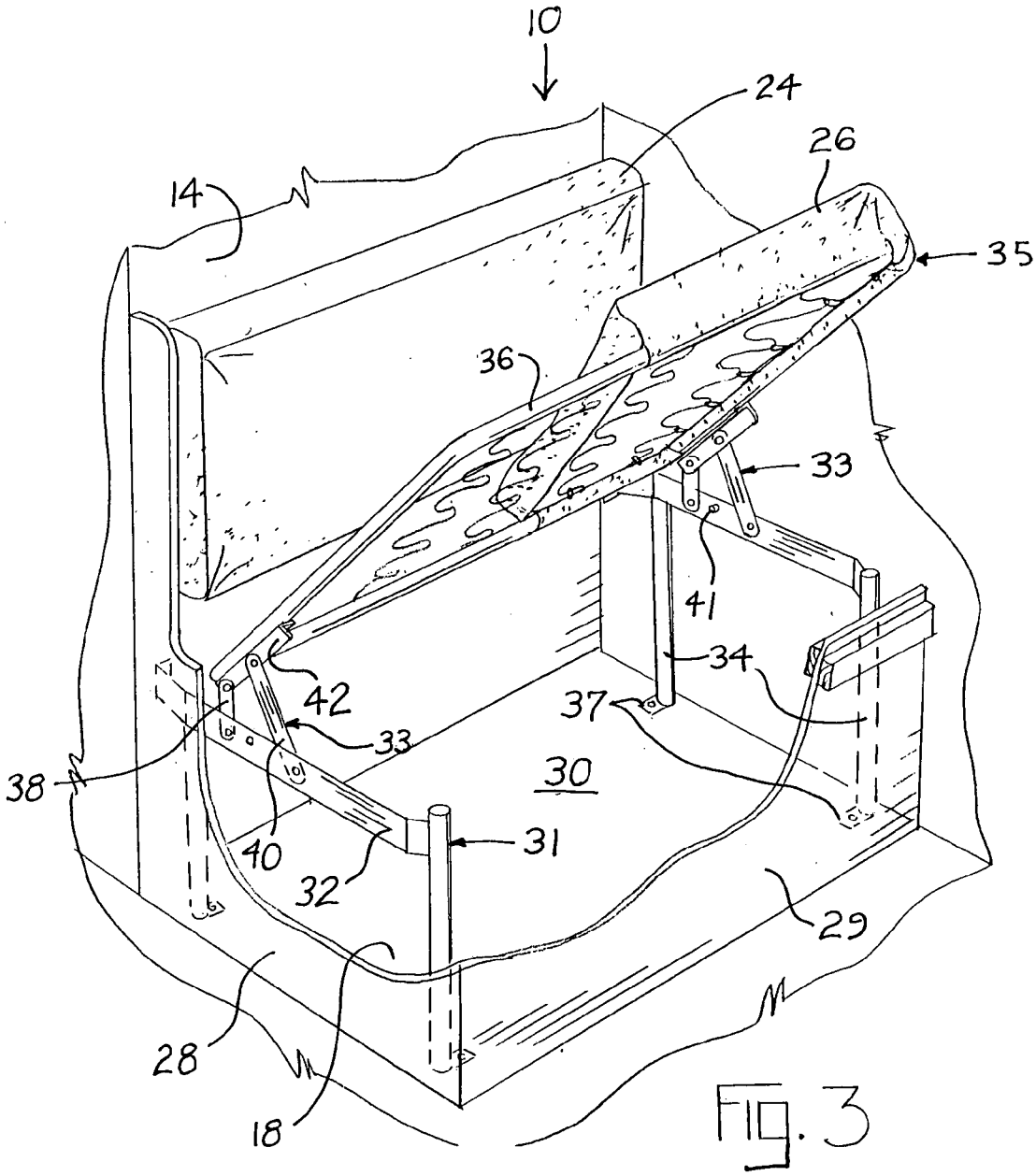
FIG. 3 is a perspective view of the fold-up seat with the cover partially opened up.

Focusing now on the fold-up seat 10 in isolation, as best shown in FIG. 3, the seat includes seat storage walls such as sidewalls 28, front wall 29, and rear wall 14 supported by floor 18, which define a storage area 30 of generally rectangular shape. Rear wall 14 may either be one of the walls of the mobile living quarters or an independent wall. Rear wall 14 extends above seat storage walls 28 to define a backrest on which back cushion 24 may be attached. Preferably back cushion 24 is attached to rear wall 14 using a standard hook and loop connection 31 to facilitate easy attachment and removal.

Seat frame 31, forming a part of the storage area 30, is positioned within storage area 30 and includes legs 34, which are carried by floor 18 and support a pair of opposing beams 32. A pair of hinges 33 are carried one on each side of the seat by beams 32 and shiftably connect beams 32 with brackets 42. Cushion frame 36 is attached to brackets 42 with fasteners 43 and carries seat cushion 26. Legs 34 may be fastened to floor 18 with fasteners (not shown) inserted through tabs 37. Seat frame 31, hinge assembly 33, brackets 42, and cushion frame 36 are all preferably constructed of steel or aluminum, but may be made of any suitable material.

Figure 4:
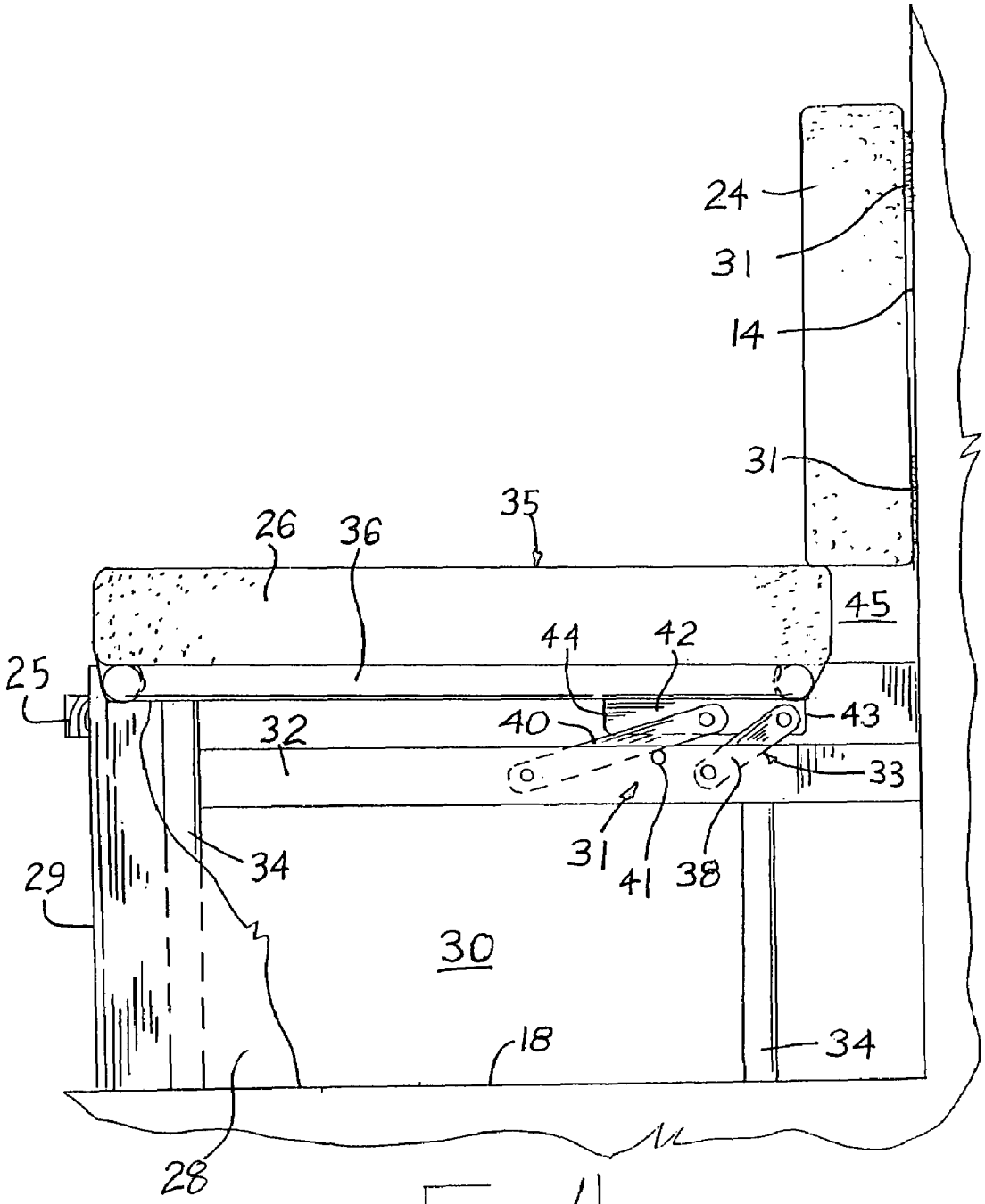
FIG. 4 is a detail of the cover's hinge assembly in its closed position.
Figure 5:
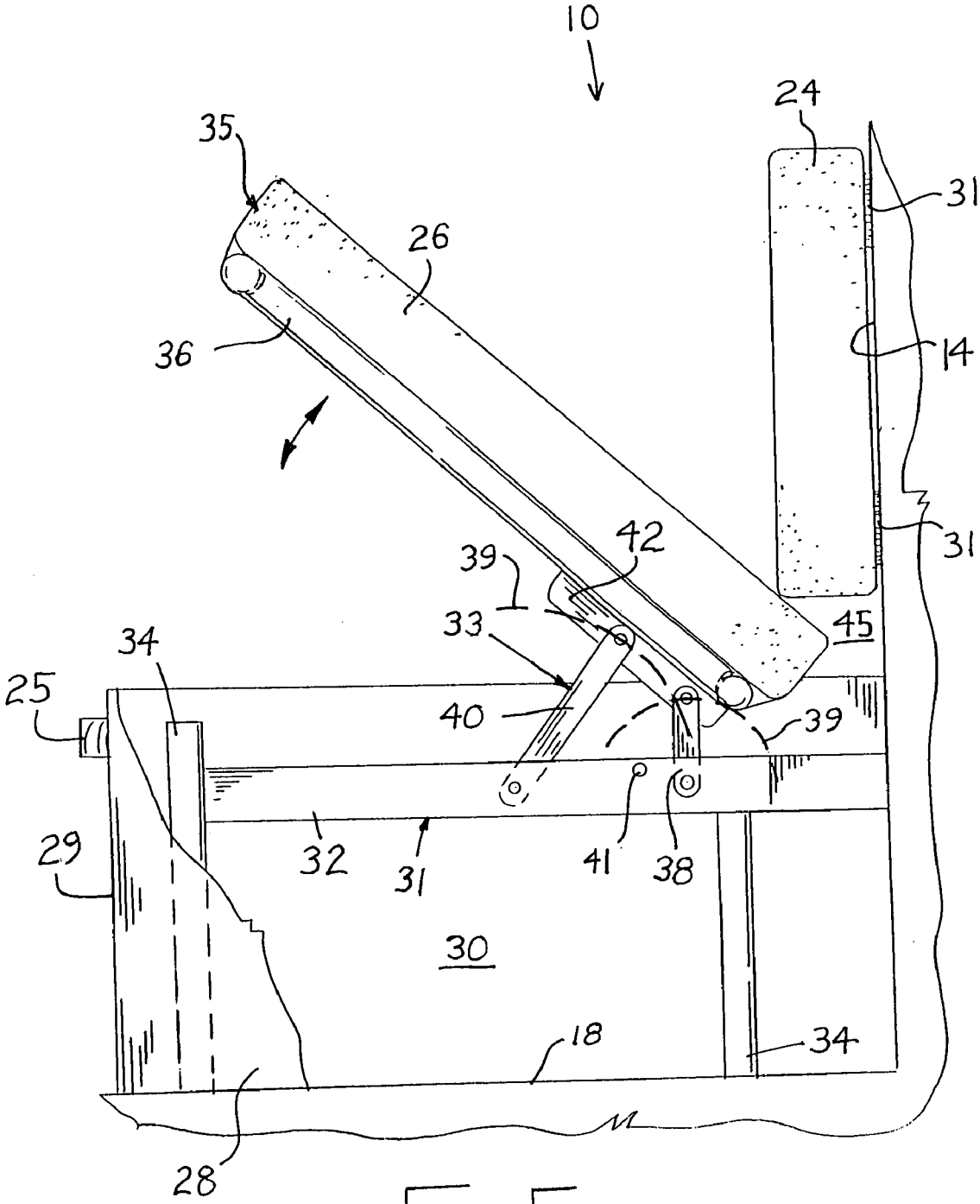
FIG. 5 is a detail of the cover's hinge assembly in a partially opened position; and, FIG. 6 is a detail of the seat's cover's assembly in its open position.
Figure 6:
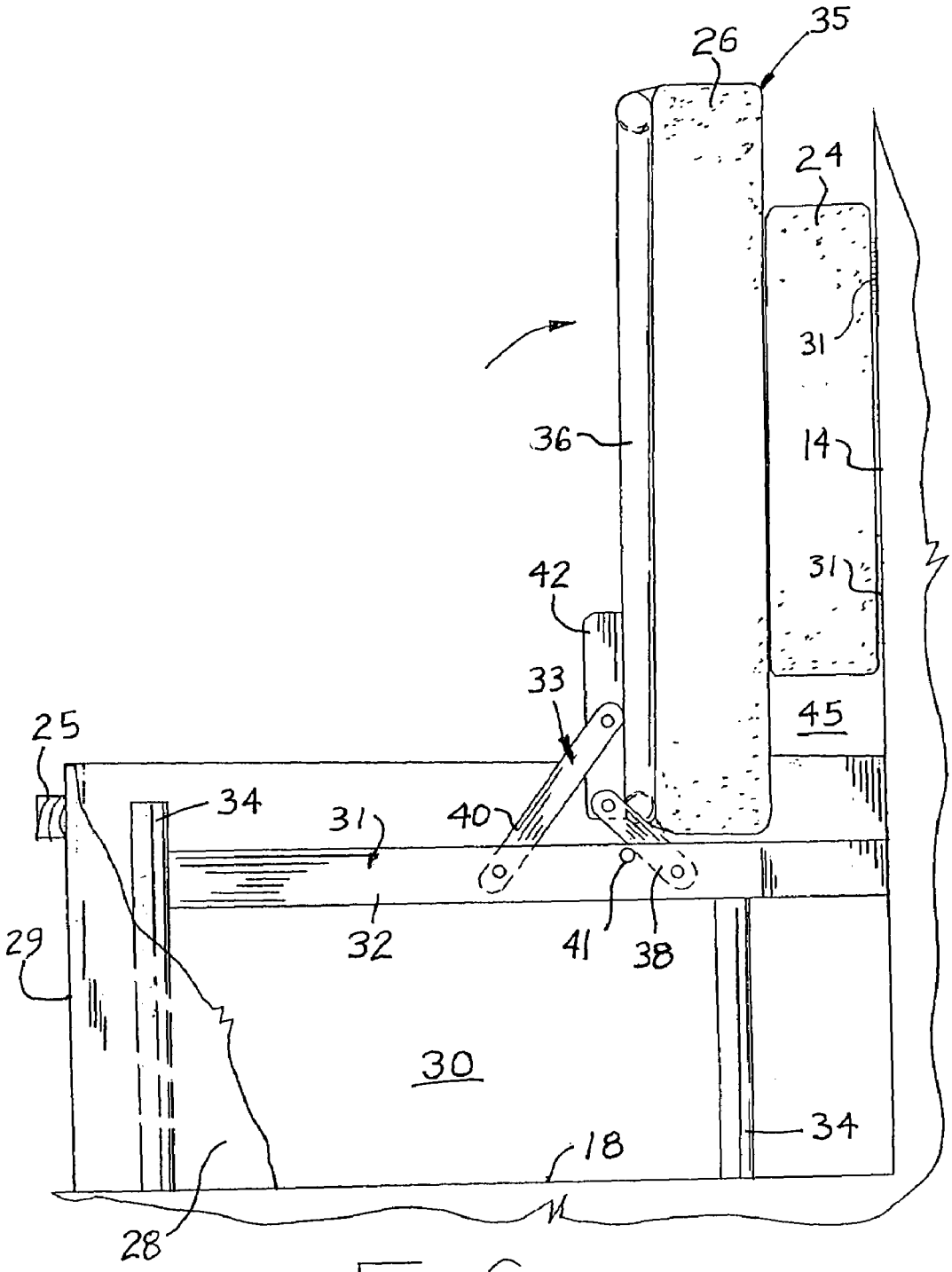

Turning now to FIGS. 4–6, FIG. 4 shows hinges 33 in their closed position, FIG. 5 shows hinges 33 in a partially open position, and FIG. 6 shows the hinges 33 in their open position. Each hinge 33 includes a pair of linkages 38, 40 pivotally connected to beam 32 at one of each of their ends by any well known connection such as a pin. At the other end of each linkage 38, 40, each linkage is pivotally connected to bracket 42. Linkage 38 and linkage 40 each have different swing radii 39 that overlap each other. Pegs 41 protruding out from beams between linkages 38, 40 act as stops for the hinges 33. When hinge 33 is closed, linkage 40 abuts peg 41, thereby preventing the hinge from shifting further in the closed direction. When hinge 33 is open, linkage 38 abuts peg 41, thereby preventing the hinge from shifting further in the open direction. Peg 41 is located in order to allow cover 35 to rest slightly beyond vertical in the open position, which helps the cover to resist closing unintentionally. Preferably, cover 35 will rest approximately three degrees past vertical toward the rear of the frame 31 when completely opened.

Due to this dual radius linkage system, as hinge 33 is shifted from its closed position to its open position, the rear end 43 of the bracket translates forward while the forward end 44 of the bracket rotates upward, which provides an increased space 45 at the rear of frame 28 behind bracket 42 when seat cover 35 is folded up or open. Thereby, hinge 33 accommodates the thickness of cushions 24, 26 to be adjacent and generally parallel to each other when cover 35 is open and allows seat cushion 26 to be underneath back cushion 24 when cover 35 is closed. Although such a space could be provided by a single axis hinge laterally spaced from the rear wall, such a hinge would cause at least part of the seat platform and/or seat cushion to rotate down into the storage area or else leave a gap between the rear wall and the rear end of the seat platform. With dual linkage hinges 33 however, the rear edge of the seat is maintained generally above the storage area 30 between the open and closed positions thereby not causing interference with usable storage space. Simultaneously, the rear-end of the seat platform rests adjacent the rear wall when the seat is folded down. A slot or hole in bracket 42 accommodates a fastener for fastening cushion frame 36 to bracket 32 in any ordinary manner. Seat cushion 26 or other well known seating platform is then fastened to cushion frame 36 to form a comfortable platform for sitting.

In order to use the fold-up seat 10 and its storage area 30, cover 35, which includes seat cushion 26 and cushion frame 36, is lifted at its forward edge and rotated about hinges 33 from a closed position to an open position. Storage area 30 may then be accessed from above. When it is desired to either close storage area 30 or to sit on cover 35, the cover is then shifted back to its closed position. In the closed position, cushion frame 36 rests on the tops of forward legs 34 to provide additional support for the cover. If back cushion 24 is too thick to accommodate complete opening of the fold-up seat 10, it may be removed from rear wall 14 at its hook and loop fasteners and placed apart from the fold-up seat. Cover 35 may then be opened and closed, and back cushion 24 returned to its position on rear wall 14 when the cover is again closed. Furthermore, the storage area underneath the seat platform may be easily accessed whether the fold-up seats are arranged to be used as either seats or a bed.

The above description is only meant to exemplify the invention to enable others to reproduce it. The description is not intended to be a limitation from other minor and obvious variations on the embodiment described all of which variations are expressly included herein.

I claim:

1. A fold-up seat for use in a mobile living quarters having a wall, said fold-up seat comprising a storage area and a cover having an open position allowing access to said storage area and a closed position covering said storage area, a hinge assembly shiftably attached to said storage area at one end thereof and carrying a bracket mounted to said cover, wherein said hinge assembly includes a pair of spaced linkages each pivotally attached between said storage area and said cover having different fixed radii of movement for guiding said bracket and cover along a path including both rotation and movement of said cover away from said one end when the cover is shifted between said open and closed positions, wherein said wall extends above said cover to define a back rest, said hinge assembly located adjacent said wall, said cover includes a first cushion, and a second cushion attached to said wall, said hinge assembly being laterally spaced from said wall such that said cover folds up against said wall in said open position with said first and second cushions adjacent and generally parallel with each other.

2. The fold-up seat of claim 1 wherein said path includes rotation of said cover about said hinge assembly and translation of said cover relative to and over said storage area when said cover is shifted between said open and closed positions.

3. A sofa assembly usable in a mobile living quarters, said sofa assembly including a pair of opposing fold-up seats spaced from each other and a central platform removably carried by and between said opposing fold-up seats to define a generally continuous sleeping surface, wherein each said fold-up seat comprises a storage area and a cover having an open position allowing access to said storage area and a closed position covering said storage area, a hinge assembly shiftably attached to said storage area at one end thereof and carrying a bracket mounted to said cover, wherein said hinge assembly includes a pair of linkages pivotally attached between said storage area and said cover having two different fixed radii of movement for guiding said bracket and cover along a path including both rotation and movement of said cover away from said one end when the cover is shifted between said open and closed positions.

* * * * *